US006276579B1

(12) United States Patent
DeLoach

(10) Patent No.: US 6,276,579 B1
(45) Date of Patent: Aug. 21, 2001

(54) SOFT-SIDED BEVERAGE COOLER

(75) Inventor: Terri L. DeLoach, Houston, TX (US)

(73) Assignee: Igloo Products Corporation, Houston, TX (US)

( * ) Notice: Subject to any disclaimer, the term of this patent is extended or adjusted under 35 U.S.C. 154(b) by 0 days.

(21) Appl. No.: 09/332,049

(22) Filed: Jun. 14, 1999

(51) Int. Cl.[7] ..... A45F 3/16

(52) U.S. Cl. ..... 224/148.3; 224/148.5; 220/592.24; 222/158; 222/175; 383/16; 383/110

(58) Field of Search ..... 62/457.4, 457.8; 150/127, 900, 901; 215/12.1, 13.1; 222/158, 175; 224/148.1, 148.3, 148.4, 148.5, 148.6, 148.7, 236, 237, 246; 383/84, 86, 16, 110, 111; 220/592.24; 206/223, 541, 547

(56) References Cited

U.S. PATENT DOCUMENTS

| | | | | |
|---|---|---|---|---|
| D. 276,572 | * | 12/1984 | Bethea | D2/400 |
| D. 383,361 | * | 9/1997 | Melk | D7/607 |
| D. 385,106 | * | 10/1997 | Melk | D3/215 |
| D. 391,120 | * | 2/1998 | Melk | D7/607 |
| D. 398,192 | * | 9/1998 | Rausch | D7/607 |
| D. 406,989 | * | 3/1999 | Rausch | D7/624 |
| D. 417,369 | * | 12/1999 | Rausch | D7/624 |
| 1,373,155 | * | 3/1921 | Tebbetts | 206/217 |
| 2,324,495 | * | 7/1943 | Deming | 383/16 X |
| 3,814,288 | * | 6/1974 | Westrich | 222/129 |
| 4,648,121 | * | 3/1987 | Lowe | 224/637 X |
| 4,826,060 | * | 5/1989 | Hollingsworth | 383/16 X |
| 4,929,094 | * | 5/1990 | Becker | 383/111 X |
| 5,188,266 | * | 2/1993 | Loulias | 224/148 |
| 5,638,955 | * | 6/1997 | Calciano | 206/320 |
| 5,660,476 | * | 8/1997 | DeCoster | 383/110 X |
| 5,848,734 | * | 12/1998 | Melk | 222/175 |
| 5,954,238 | * | 9/1999 | Rausch | 222/158 |

OTHER PUBLICATIONS

1999 Igloo Product Catalog; Igloo Inquisitor, copyright 1998; p. 48.

* cited by examiner

*Primary Examiner*—Jes F. Pascua
(74) *Attorney, Agent, or Firm*—Nixon & Vanderhye PC

(57) ABSTRACT

A soft-sided container assembly is provided that includes a beverage container liner and an insulating cover for generally maintaining the temperature of the container contents during transport and/or short term storage. The container assembly is adapted to facilitate access to and/or removal of the container liner from the insulating cover. Thus, the top panel of the insulating cover is provided as a cover flap structure having a container overlying portion and a flap attachment portion that is detachably secured may be attached to the side wall. Because the top panel overlies substantially the entire exposed top wall of the container liner, detaching the top panel substantially fully opens the cover for removal of liner. In addition or in the alternative, one or more grip structures are provided adjacent the bottom of the insulating cover, for being manually grasped, to provide suitable resistance whereby the liner can be removed from the cover.

20 Claims, 6 Drawing Sheets

SOFT-SIDED BEVERAGE COOLER

BACKGROUND OF THE INVENTION

1. Field of the Invention

The present invention relates to a beverage cooler structure and, in particular to an insulating cover for a beverage container that has a bottom strap to facilitate cover removal from the container. The present invention also relates to an insulating cover having an improved top closure structure.

2. Description of the Related Art

A variety of rigid insulated containers are known and used for transporting hot or cold beverages and/or other food stuffs. Typically, because of their size, and insulative characteristics, such coolers and totes are filled with beverages and the like just before departure. The insulative structure of the rigid container thereafter generally maintains the temperature of the food and drink during transport.

Recently, softsided coolers, in particular softsided beverage coolers, have been gaining popularity. Such softsided beverage coolers include a relatively rigid beverage container, sometimes referred to as a liner, which has a screw top closure. An insulative cover receives the beverage container and generally maintains the temperature of the container contents during transport, until consumption. The lightweight structure of the insulative cover, the comfort afforded by the soft exterior, the provision of a shoulder strap, and the like, have all been desirable attributes of such coolers from the consumer's point of view. Moreover, while, as noted above, conventional rigid insulating containers must be filled immediately before departure, softsided beverage cooler liners can be filled in advance, stored with other beverage containers in the refrigerator, and then simply placed in the insulative cover at the time of departure.

Softsided beverage coolers have not, however, been without deficiencies. Indeed, attachment and removal of the top panel of some prior art insulating jackets has been problematic. More specifically, some such closure structures provide a top panel that has a hole for receiving the neck of the beverage container liner. However, it can be difficult to fit such an apertured cover over the container neck, particularly when the cap is attached to it. The same is true when the top panel is to be opened for liner removal and the cover must be removed from the neck and cap. If the hole in the cover provides a relatively snug fit, the consumer must tug and wrestle with the cover to remove it for liner disengagement.

Furthermore, because of the softsided characteristics of the container cover, and its relatively snug fit to the container liner, in practice removing the liner from the cover can require a great deal of pulling and tugging on the container, as well as crushing and distortion of the side walls of the cover, to free the liner from the insulative cover.

Thus, it is clear that modifications to the conventional soft cover structure would be desirable to make softsided beverage coolers more consumer friendly and, in particular, to provide easier access to and removal of the container liner.

BRIEF SUMMARY OF THE INVENTION

It is an object of the present invention to provide an insulated container assembly comprising a relatively rigid container and an insulating cover for receiving the container wherein a top panel of the insulating cover can be easily disposed to substantially completely overlie the top wall of the container liner.

It is a further object of the present invention to provide an insulative cover structure including a grip structure which allows the consumer to hold the insulative cover from at or adjacent the base, to facilitate liner removal.

The foregoing objects are realized in accordance with the present invention by providing a container assembly that comprises a relatively rigid container liner having a bottom wall, side walls, a top wall, a neck protruding upwardly relative to the top wall and a cap attached to the neck, the neck being laterally offset whereby substantially an entirety of the top wall is disposed to one side of the neck; and an insulating cover having a bottom wall, front and rear wall portions, and first and second side wall portions, the bottom wall and the wall portions together defining a container liner receiving cavity in which the container liner is selectively disposed, the insulating cover further comprising a top panel for overlying the top wall of the container liner, the top panel having a first end secured to the first side wall portion adjacent an upper peripheral edge thereof so that the top panel can be selectively pivoted relative to the first side wall portion to selectively overlie the top wall of the container liner disposed in the cavity, the top panel including a first portion for overlying the top wall of the container and a second, tab portion for overlying a portion of the second side wall portion, the tab portion having a first closure structure provided on an undersurface thereof, the second side wall portion having a connector structure complimentary to the first connector structure for detachably engaging the tab portion of panel to secure the top panel in overlying relation to the container liner.

The foregoing objects are also realized in accordance with the present invention by providing a container assembly that comprises a relatively rigid container liner and an insulating cover having a bottom wall and at least one side wall terminating at an upper edge generally opposite of the bottom wall, the bottom wall and at least one side wall together defining a container liner receiving cavity for receiving the container liner, at least one carrying strap secured to the insulating cover; and a grip structure secured to the insulating cover on or adjacent the bottom wall thereof for holding the insulating cover when the container liner is removed from the cavity.

BRIEF DESCRIPTION OF THE DRAWINGS

These, as well as other objects and advantages of this invention, will be more completely understood and appreciated by careful study of the following more detailed description of a presently preferred exemplary embodiments of the invention taken in conjunction with the accompanying drawings, in which.

DETAILED DESCRIPTION OF THE INVENTION

Figure 1:
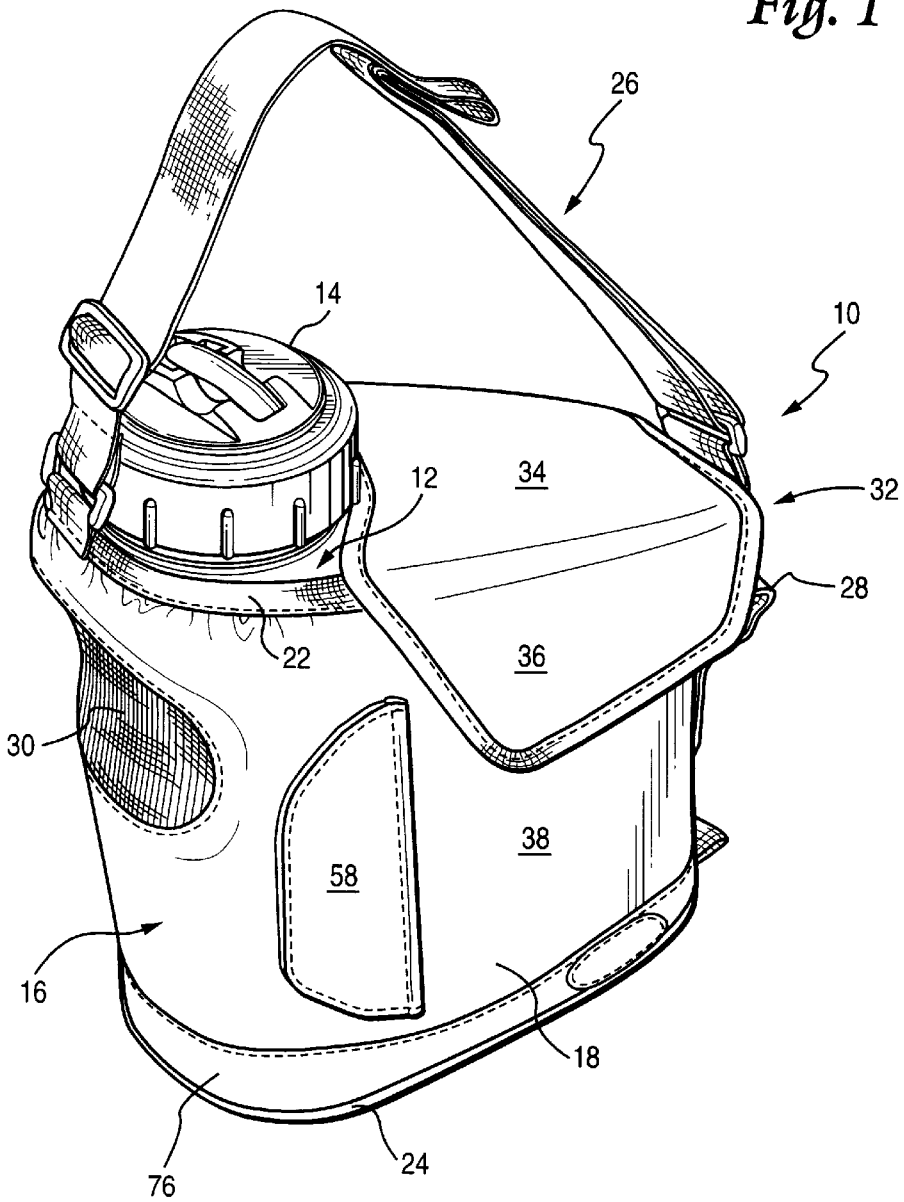
FIG. 1 is a front, right perspective view, from above, of a softsided beverage cooler in accordance with the invention.
Figure 2:
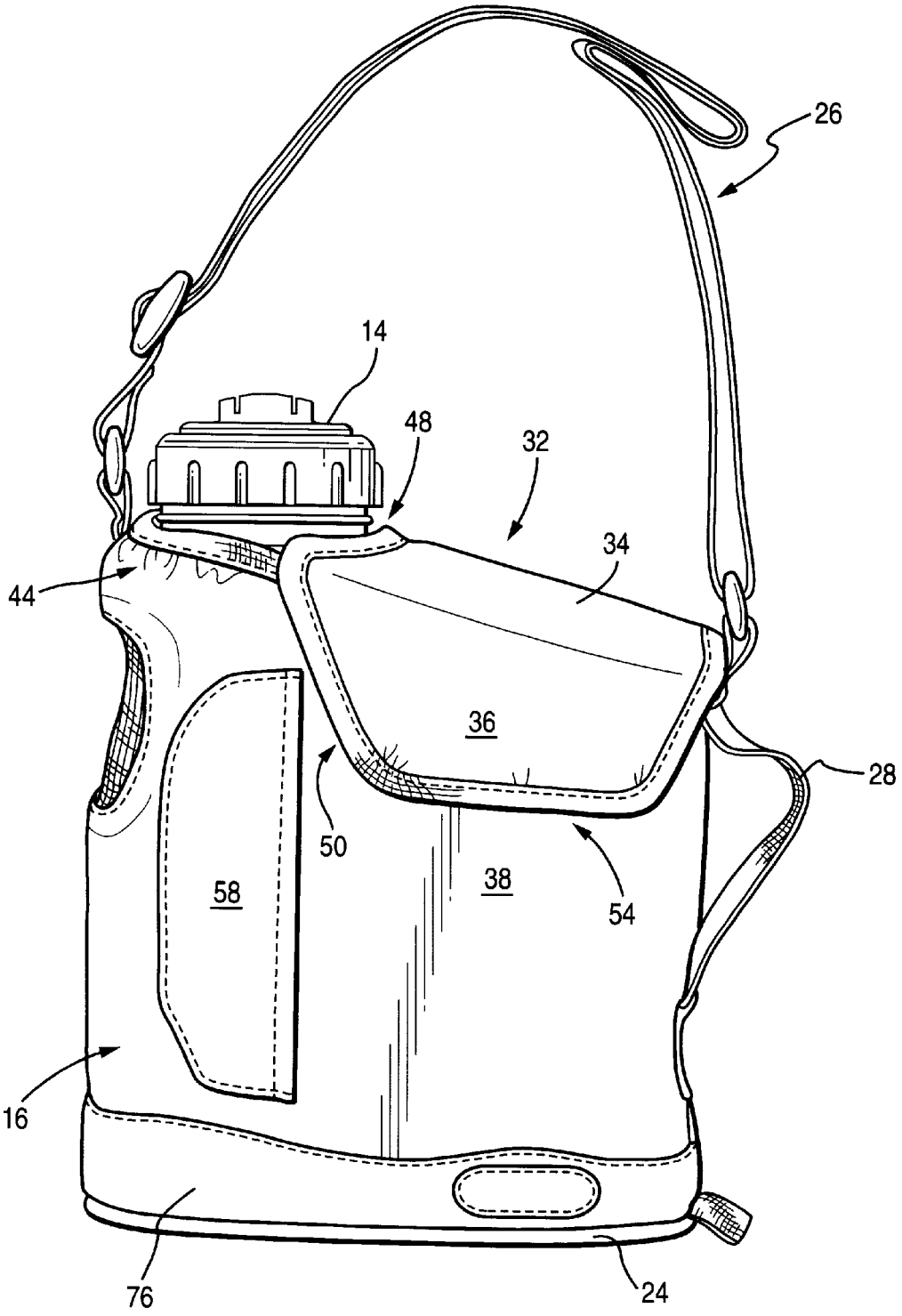
FIG. 2 is a right side elevation of the cooler of FIG. 1.
Figure 4:
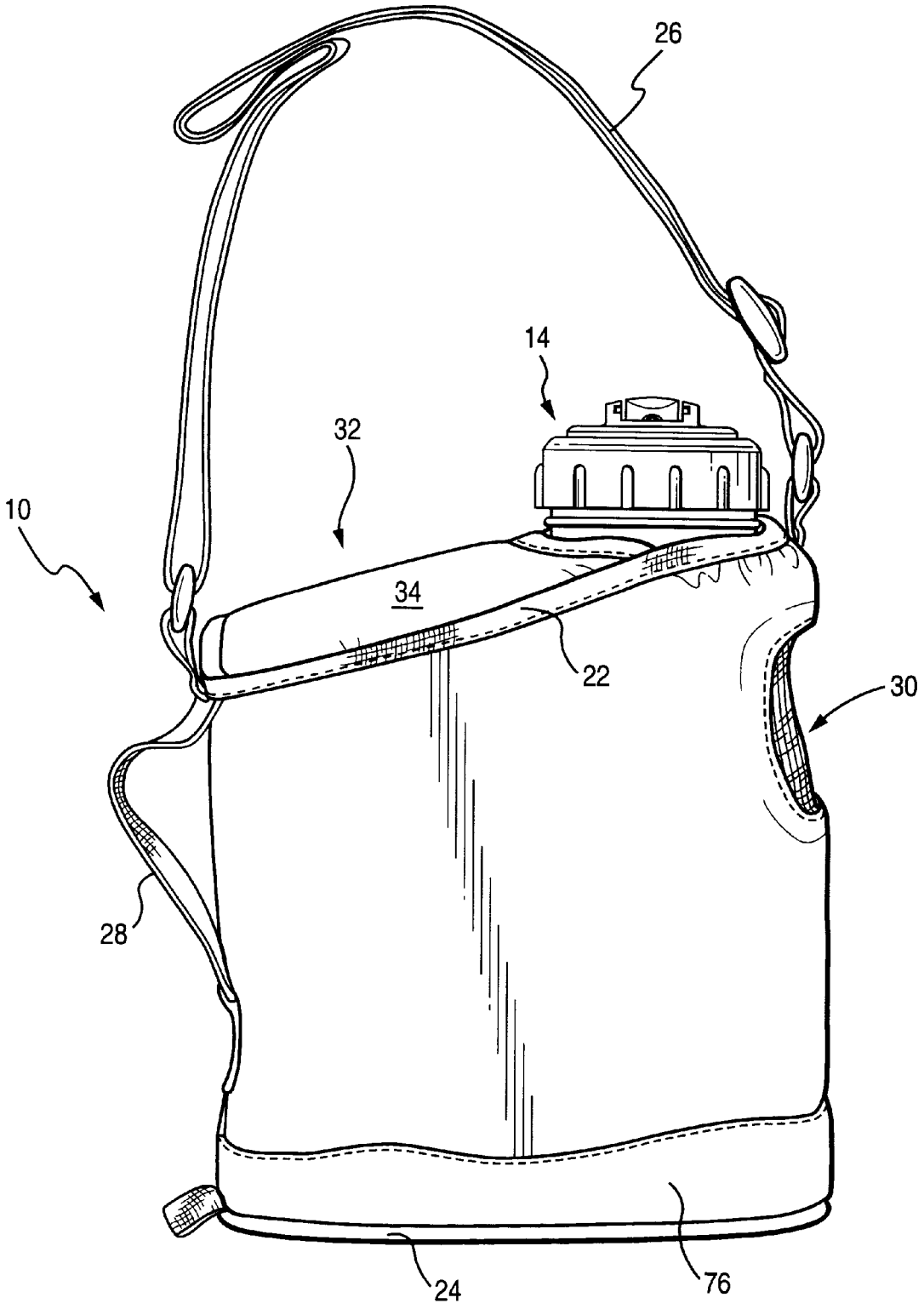
FIG. 4 is a left side elevation of the cooler.

An insulated beverage container assembly 10 embodying the invention is illustrated by way of example in FIG. 1. With reference to FIGS. 1, 2 and 4, the softsided container provided in accordance with this exemplary embodiment includes a beverage container liner 12 having a cap closure 14 threadly engaged therewith and an insulating cover 16 for generally maintaining the temperature of the container contents during transport and/or short term storage. The insulating cover 16 is, for example, of a three layer construction (not shown in detail), including an outer layer 18 of a flexible fabric material such as nylon, an inner layer 20 which is preferably a waterproof sheet material and an intermediate insulating layer. A binding material 22 of, for example, nylon webbing or tape extends over the free, upper edge of the insulating cover 16 and a conventional piping trim 24 is provided about the bottom perimeter, to improve the aesthetics of the liner and to improve the integrity of the assembly 10 at the edges. The binding tape 22 preferably exhibits a degree of resiliency to generally conform to the configuration of the liner 12 adjacent the top front edge, without hampering liner removal, as described more fully below.

The insulating cover 16 has, for example, a shoulder strap 26 attached adjacent the top edge of the cover, e.g., at the front and at the rear, to facilitate transport. Another handle 28 may be provided on the rear of the assembly 10 as a hand grip. In the illustrated embodiment, an elastic panel 30 is provided on a portion of the front wall of the softsided cooler cover 16, with a corresponding recess being provided in the front wall of the container liner 12. This allows the consumer to hold and support the assembly 10 while pouring and provides for a more sure grip than the smooth nylon material 18 of the remainder of the cover outer surface.

Figure 3:
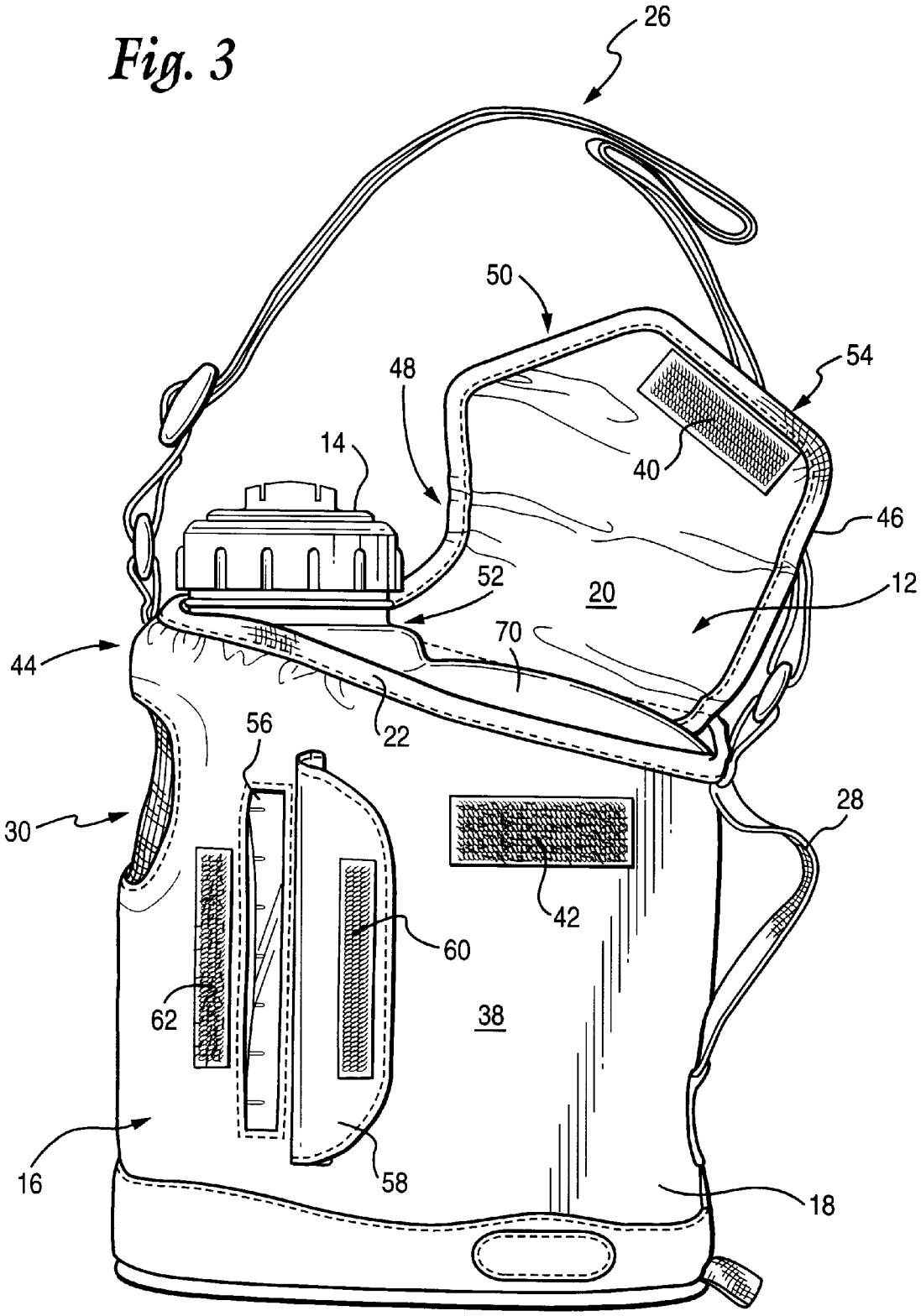
FIG. 3 is a right side elevation of the cooler, with the cover flap opened.

It is object of the invention to facilitate removal of liner 12 from the insulating cover 16. To that end, the top panel or wall 32 of the insulating cover 16 is provided as a cover flap structure having a container overlying portion 34 and a flap attachment portion 36. The downwardly depending flap attachment portion 36 may be attached to the side wall 38, e.g., with Velcro-type hook and loop fastening material 40, 42, as shown in FIG. 3. The hook and loop fastening material provides for quick and easy detachment or unfastening of the flap 36 from the cover side wall 38. Moreover, because the panel structure 32 overlies substantially the entire exposed top wall 70 of the container liner 12, detaching the top panel 32 substantially fully opens the cover 16 for removal of liner 12.

To provide for a more snug fit of the insulating cover 16 on the container liner 12, in the illustrated embodiment, the forward portion of the cover 16 is slightly gathered as at 44 so as to lap over the top, front edge of the container liner 12. Because the binding tape 22 exhibits resiliency, however, the lap over of the forward edge does not obstruct liner insertion or removal, as described hereinbelow.

As can be further seen in FIG. 3, the top panel 32 of the insulating cover 16 has a relatively straight rearward edge 46 and a forward edge including an arched portion 48 and a generally straight portion 50. As can be appreciated from FIGS. 1–3, the generally arched portion 48 accommodates the container neck 52 without interfering with top panel 32 attachment and detachment. The relatively straight forward edge 50 provides a more truncated terminal edge 54 sufficient for attachment to the side wall 38 which overlies the generally flat side wall 72 of the beverage container.

In the illustrated embodiment a volume window 56 is provided in the side wall 38 of the insulating cover 16 and is provided with a closure flap 58. The closure flap 56 has, for example, a Velcro-type fastener 60 so that it can be opened to observe the container contents and volume, and otherwise closed and fastened to the complimenting Velcro-type fastener 62 on the side wall 38, to maximize the insulating characteristics of the container cover. As is apparent, the straight portion 50 of the cover flap 36 avoids obstruction of the volume window access flap 58.

As is apparent from the foregoing, the top panel or wall 32 of the insulating cover 16, provided in accordance with the invention, with its container overlying portion 34 and is its downwardly depending flap 36 provides for a quick and secure closure of the container assembly, substantially fully overlies the container liner 12 to insulate the same, and yet can be quickly disengaged even with a one handed operation, for liner 12 removal. Thus, it can be seen that the top wall 32 of the insulating cover provided in accordance with the invention facilitates quick and easy access to the container liner 12 for removal, as well as quick and easy closure of the assembled cooler 10.

It was a further object of the invention to provide a softsided beverage cooler that facilitates not only access to but removal of the container liner from the insulating cover. Thus, in accordance with the present invention, one or more grip structures 64, 66 are provided adjacent the bottom of the insulating cover 16, for being manually grasped, to provide suitable resistance whereby the liner 12 can be removed from the cover 16.

Figure 5:
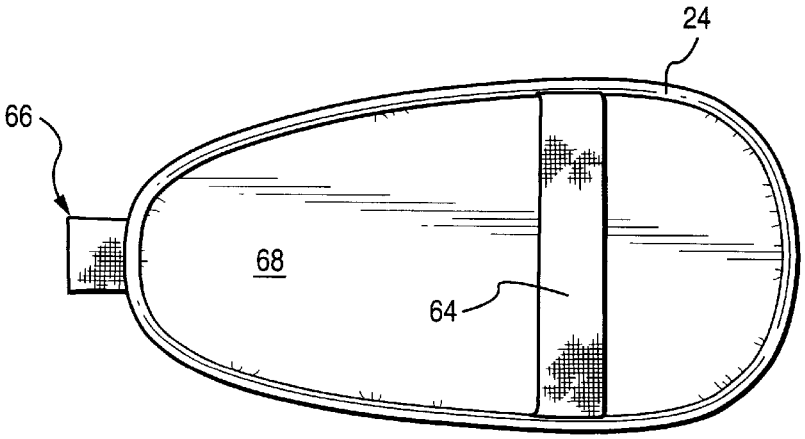
FIG. 5 is a bottom plan view of the cooler.

First and second exemplary bottom grip structures 64, 66 are illustrated by way of example in FIG. 5. More particularly, a bottom strap or tugger 64 is fastened at each longitudinal end thereof in the peripheral seam of the bottom panel 68, and the strap 64 is substantially unattached to the bottom 68 therebetween. Thus, as shown, for example in FIG. 6, the bottom strap or tugger 64 can be grasped by the consumer to hold the insulating cover 16 so that, with the top panel 32 open, the container liner 12 can be grasped and pulled out of the insulating cover 16. Where the cap 14 is securely attached to the liner 12, the liner 12 can be grasped by the attached cap, as shown. In the alternative, the container liner 12 can be grasped from rearwardly of the cap 14 with the hand overlying the top wall 70 of the liner and fingers grasping the side walls 72, for example at the recesses 74 conventionally provided in liner side walls. When the insulating cover 16 is held by grasping the bottom strap 64, removal of the liner is quick and easy, and no grasping, tugging or collapsing of the walls of insulating cover 16 is required. In the presently preferred embodiment, the bottom strap 64 is sized so as to be disposed in parallel, generally closely adjacent relation to the bottom wall 68 of the insulating cover 16, so as not to protrude or gape. The flexibility of the cover allows the strap to be displaced from the bottom wall sufficiently for, e.g., one to four fingers to be slid thereunder for grasping the bottom strap. When the container liner is reinserted, the bottom strap will substantially return to its generally flush disposition. The grip structure 64 provided on the bottom of the container assembly 10 is preferably formed, for example, from a nylon ribbon material similar to but generally lighter in weight than the nylon strapping for handles 26 and 28. Thus the strap 64 will not hinder stable placement of the assembly 10 in an upright disposition. Where the bottom rim of the container spaces the bottom wall from a surface on which the container is disposed, the strap 64 may be defined by a cord or small rope. Thus, the term strap as used herein with reference to the grip structures is not to be limited to the generally flat, nylon ribbon of the presently preferred, illustrated embodiment.

Figure 6:
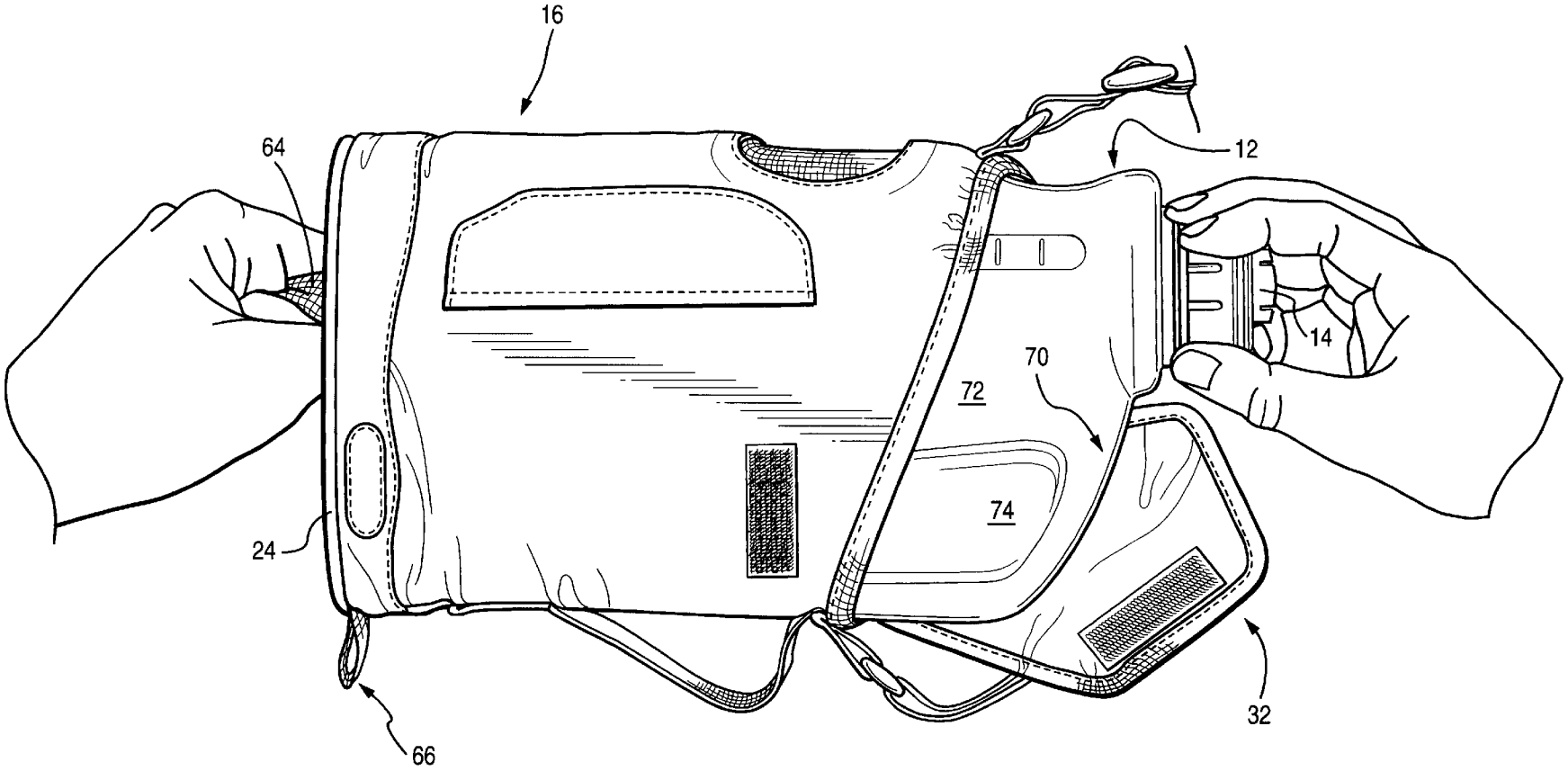
FIG. 6 is an exploded view showing the liner being removed while the cover is held by a bottom strap.
Figure 7:
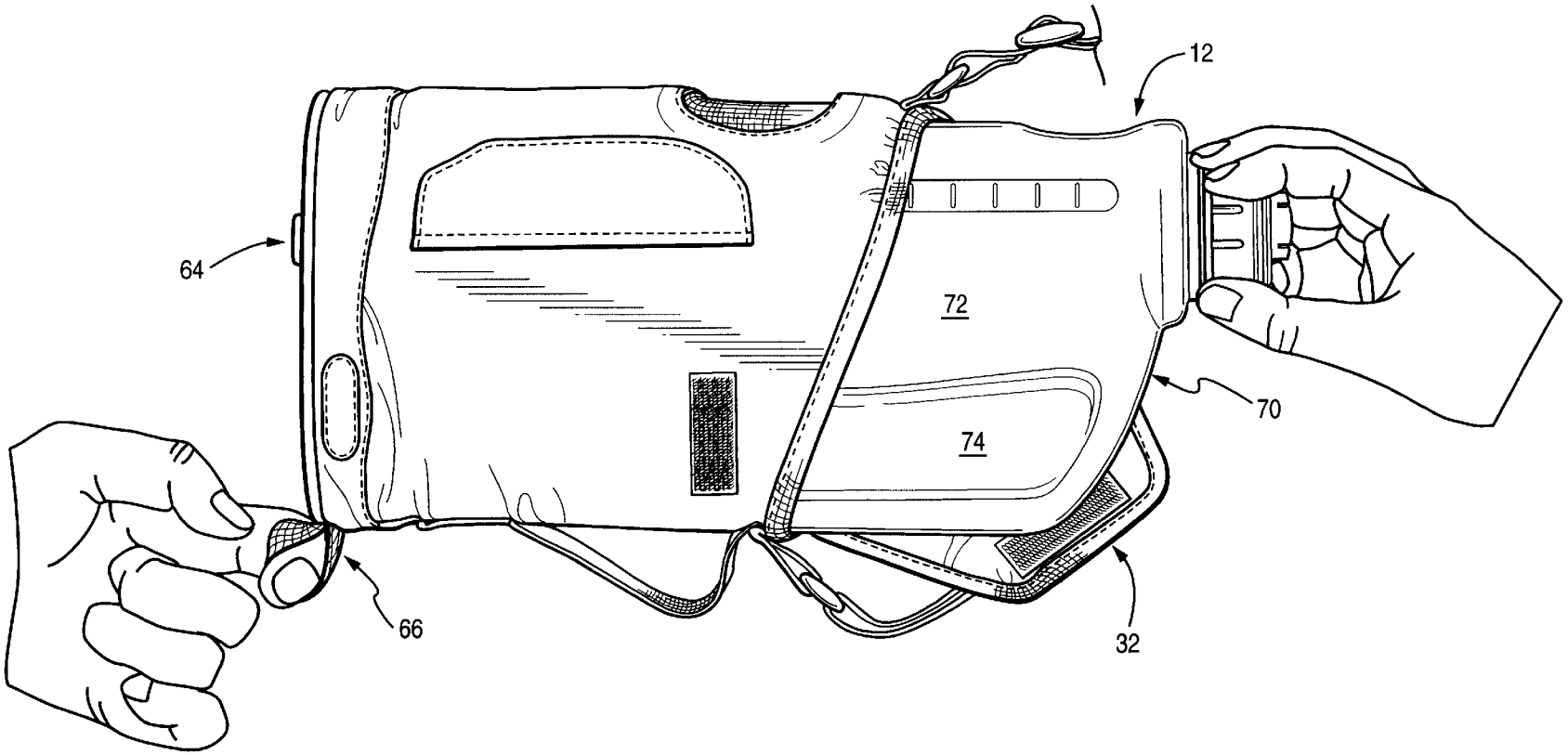
FIG. 7 is an exploded view showing the liner being removed while the cover is held by a bottom tab.

In addition or as an alternative to providing a transverse bottom strap 64, as shown in FIG. 5 and described with reference to FIG. 6, a pull loop 66 can be provided in accordance with the invention for grasping the insulating cover 16 during liner removal. In the illustrated embodiment, the pull loop 66 is sized for receiving, for example, a single digit of the consumer's hand. A relatively small loop is presently preferred because it minimizes the risk that the pull loop will undesirably or unintentionally be snagged or otherwise interfere with use of the softsided cooler. As illustrated in FIG. 7, the consumer grasps the pull tab, e.g., with one finger, to hold the insulating cover 16 while the liner 12 is pulled from therewithin. Again, the liner may be grasped by its securely attached cap 14 or adjacent top wall 70. The pull tab or loop 66 of the illustrated embodiment is formed, for example, from a nylon ribbon material as described above for strap 64. The pull loop may, however, be formed from a cord or small diameter roping. Thus, the term tab or loop as used herein with reference to the grip structure is not to be limited to the generally flat, nylon ribbon of the presently preferred, illustrated embodiment.

In the illustrated embodiment, the pull tab is formed as a loop 66 for the consumer's finger to be inserted therethrough for one finger pulling. It is to be understood, however, that advantages may be realized nevertheless by providing a tab that does not define a loop but is instead grasped, e.g., by the thumb and forefinger during liner removal. Indeed, even if a loop is provided, the consumer may grasp the loop from outside rather than inserting their finger thereinto. As even a further alternative, the loop can be enlarged somewhat relative to the size shown in the illustrated embodiment, for example to accommodate two or more fingers.

Although in the illustrated embodiment, strap 64 and pull loop 66 are attached to the insulative cover 16 at the bottom peripheral seam, below the piping, it is to be understood that a strap and/or pull tab as disclosed hereinabove need not necessarily be attached at the seam but could be fastened, for example by stitching, directly to bottom panel 68 or to the front, side, or rear wall portions of the cover 16, adjacent the bottom peripheral edge, for example by stitching to the bottom perimeter trim 76.

The softsided beverage container illustrated in FIGS. 1–7 may be readily adapted through appropriate proportional sizing to receive, e.g., a one half gallon liner, a one gallon liner or liner greater or smaller volume. The top wall or panel 32 of the insulating cover 16 is particularly adapted to beverage coolers having an offset neck, as shown in the illustrated example, so that substantially the entire top wall 70 of the beverage container liner 12 is disposed to one side, in the illustrated embodiment to the rear, of the container neck.

The bottom strap or pull tab of the invention, however, is not specifically adapted to a particular container shape or volume. Thus, it may be adapted to, for example, insulating covers for beverage containers of square, rectangular, oblong, or circular configuration. Indeed, a grip structure as described hereinabove may be incorporated in any of a variety of container assemblies wherein a relatively rigid liner is to be selectively removed from a relatively close fitting, soft-sided insulating jacket or cover.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

What is claimed is:

1. A container assembly comprising, in combination:

a relatively rigid container liner having a bottom wall, side walls, a top wall, a neck protruding upwardly relative to said top wall and a cap attached to said neck, said neck being laterally offset whereby substantially an entirety of said top wall is disposed to one side of said neck; and an insulating cover having a bottom wall, front and rear wall portions, and first and second side wall portions, said bottom wall and said wall portions together defining a contains liner receiving cavity in which said container liner is selectively disposed, said insulating cover further comprising a top panel for overlying said top wall of said container liner, said top panel having a first end secured to said first side wall portion adjacent an upper peripheral edge thereof so that said top panel can be selectively pivoted relative to said first side wall portion to selectively overlie said top wall of said container liner disposed in said cavity, said top panel including a first portion for overlying said top wall of said container and a second, tab portion for overlying a portion of the second side wall portion, said tab portion having a first closure structure provided on an undersurface thereof, said second side wall portion having a connector structure complementary to said first connector structure for detachably engaging said tab portion of panel to secure said top panel in overlying relation to said container liner, wherein said top panel has a second, free end defining a free end edge of said second, tab portion, and first and second longitudinal side edges, said first longitudinal side edge being disposed adjacent said neck of said container liner, said second longitudinal side edge being disposed adjacent said rear wall portion of said insulating cover, said first longitudinal side edge including a first, arched portion for extending circumferentially about a portion of said neck of said container liner, and a second portion defining a first side edge of said second, tab portion, said second longitudinal side edge of said top panel being a generally straight edge, defining a generally straight rear end edge of said first portion of said top panel and a generally straight second side edge of said second, tab portion.

2. A container assembly as in claim 1, further comprising a grip structure secured to said insulating cover substantially solely on or adjacent to said bottom wall thereof for holding said insulating cover when said container liner is removed from said cavity.

3. A container assembly as in claim 2, wherein said grip structure comprises an elongated strap having at least one longitudinal end thereof secured to said cover.

4. A container assembly as in claim 3, wherein said strap comprises a generally flat, nylon ribbon.

5. A container assembly as in claim 3, wherein first and second longitudinal ends of said strap are attached to said insulating cover.

6. A container assembly as in claim 5, wherein said ends of said strap are disposed adjacent one another so-as to define a loop.

7. A container assembly as in claim 6, wherein said loop projects generally outwardly from an outer peripheral edge of said bottom wall of said cover.

8. A container assembly as in claim 5, wherein said strap is disposed so as to be in generally parallel, overlying relation to and closely adjacent said bottom wall of said cover.

9. A container assembly as in claim 1, wherein said second, portion of said first longitudinal side edge that defines said first side edge of said second, tab portion is generally straight.

10. A container assembly as in claim 1, wherein said connector structure provided respectively on said second, tab portion and said second side wall portion comprises a hook and loop-type fastening material.

11. A container assembly comprising, in combination:

a relatively rigid plastic container liner having a top wall at one end thereof and a bottom wall at an opposite end thereof with side walls extending therebetween, a neck protruding upwardly relative to said top wall and a closure component detachably secured to said neck, and an insulating cover having a bottom wall and at least one side wall terminating at an upper edge generally opposite of said bottom wall, said bottom wall and at least one side wall together defining a container liner receiving cavity generally corresponding in size and shape to said container liner for receiving said container liner, said upper edge of said at least one side wall of the insulating cover defining an opening generally opposite said bottom wall thereof, through which the plastic container liner is inserted into and removed from the insulating cover;

at least one carrying strap secured to said insulating cover; and a grip structure secured substantially solely to a bottom portion of said insulating cover defined by said bottom wall wherein said grip structure comprises a strap having first and second longitudinal ends, said first and second longitudinal ends being attached to said bottom portion of said insulating cover, of said insulating cover and a peripheral edge of said insulating cover at or adjacent a juncture of said side wall and said bottom wall, at least a portion of said grip structure being disposed adjacent to but free from attachment to said bottom portion of said insulating cover for being manually grasped to hold said bottom portion of said insulating cover when said container liner is removed from said cavity, thereby to facilitate removal of said liner from said cavity.

12. A container assembly as in claim 11, wherein said strap comprises a generally flat, nylon ribbon.

13. A container assembly as in claim 11, wherein said first and second longitudinal ends of said strap are disposed adjacent one another so as to define a loop.

14. A container assembly as in claim 13, wherein both longitudinal ends of said strap are secured to said peripheral edge and said loop projects generally outwardly from said peripheral edge of said bottom wall of said cover.

15. A container assembly as in claim 11, wherein said strap is disposed so as to be in generally parallel, overlying relation to and closely adjacent said bottom wall of said cover.

16. A container assembly as in claim 11, wherein said first and second longitudinal ends of said strap are secured to generally diametrically opposite portions of said bottom portion.

17. A container assembly comprising, in combination:

a relatively rigid container liner and an insulating cover having a bottom wall and at least one side wall terminating at an upper edge generally opposite of said bottom wall, said bottom wall and at least one side wall together defining a container liner receiving cavity for receiving said container liner;

at least one carrying strap secured to said insulating cover; and a grip structure secured substantially solely to a bottom portion of said insulating cover defined by said bottom wall of said insulating cover and a peripheral edge of said insulating cover at or adjacent a juncture of said side wall and said bottom wall, at least a portion of said grip structure being disposed adjacent to but free from attachment to said bottom portion of said insulating cover for being manually grasped to hold said bottom portion of said insulating cover when said container liner is removed from said cavity, thereby to facilitate removal of said liner from said cavity, wherein said container liner has a top wall, a neck protruding upwardly relative to said top wall and a cap attached to said neck; and said insulating cover further comprises a top panel for overlying said top wall of said container liner, said top panel having a first end secured to one portion of said side wall adjacent said upper edge thereof so that said top panel can be selectively pivoted relative to said one side wall portion to selectively overlie said top wall of said container liner disposed in said cavity, said top panel including a first portion for overlying said top wall of said container and a second, tab portion for overlying an other portion of the side wall portion, generally diametrically opposed to said one portion, said tab portion having a first closure structure provided on an undersurface thereof, said other side wall portion having a connector structure complimentary to said first connector structure for detachably engaging said tab portion of panel to secure said top panel in overlying relation to said container liner.

18. A container assembly as in claim 17, wherein said neck is laterally offset whereby substantially an entirety of said top wall is disposed to one side of said neck.

19. A container assembly comprising, in combination:

a relatively rigid plastic container liner having a top wall at one end thereof and a bottom wall at an opposite end thereof with side walls extending therebetween, a neck protruding upwardly relative to said top wall and a closure component detachably secured to said neck, and an insulating cover having a bottom wall and at least one side wall terminating at an upper edge generally opposite of said bottom wall, said bottom wall and at least one side wall together defining a container liner receiving cavity generally corresponding in size and shape to said container liner for receiving said container liner, said upper edge of said at least one side wall of the insulating cover defining an opening generally opposite said bottom wall thereof through which the plastic container liner is inserted into and removed from the insulating cover;

at least one carrying strap secured to said insulating cover; and a grip strap structure having first and second longitudinal ends and secured at each said longitudinal end to a bottom portion of said insulating cover defined by said bottom wall of said insulating cover and a peripheral edge of said insulating cover at or adjacent a juncture of said side wall and said bottom wall, for holding the bottom portion of said insulating cover when said container liner is removed from said cavity, thereby to facilitate removal of said liner from said cavity, at least a portion of said grip structure intermediate said longitudinal ends being disposed adjacent to but free from attachment to said bottom portion of said insulating cover for being manually grasped to hold said bottom portion of said insulating cover.

20. A container assembly comprising, in combination:

a relatively rigid container liner having a top wall at one end thereof and a bottom at an opposite thereof with side walls extending therebetween, a neck protruding upwardly relative to said top wall and a closure component selectively attached to said neck, and an insulating cover having a bottom wall and at least one side wall terminating at an upper edge generally opposite of said bottom wall, said bottom wall and at least one side wall together defining a container liner receiving cavity for receiving said container liner, said upper edge of said at least one side wall of said insulating cover defining an opening generally opposite said bottom wall thereof through which the container liner is inserted into and removed from the insulating cover;

at least one carrying strap secured to said insulating cover; and a grip strap structure having first and second longitudinal ends and secured at each said longitudinal end to a bottom portion of said insulating cover defined by said bottom wall of said insulating cover and a peripheral edge of said insulating cover at or adjacent a juncture of said side wall and said bottom wall, for holding the bottom portion of said insulating cover when said container liner is removed from said cavity, thereby to facilitate removal of said liner from said cavity, at least a portion of said grip structure intermediate said longitudinal ends being disposed adjacent to but free from attachment to said bottom portion of said insulating cover for being manually grasped to hold said bottom portion of said insulating cover, wherein said first and second longitudinal ends of said strap are secured to generally diametrically opposite portions of said bottom portion and at least a major portion of said strap is disposed so as to be in generally parallel, overlying relation to and closely adjacent said bottom wall of said cover.

* * * * *